US006509843B1

(12) United States Patent
Fuyama

(10) Patent No.: US 6,509,843 B1
(45) Date of Patent: Jan. 21, 2003

(54) ELECTRONIC TOLL COLLECTION SYSTEM

(75) Inventor: Seiji Fuyama, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 5 days.

(21) Appl. No.: 09/643,762

(22) Filed: Aug. 23, 2000

(30) Foreign Application Priority Data

Aug. 23, 1999 (JP) ..... 11-235821
Feb. 15, 2000 (JP) ..... 2000-036672

(51) Int. Cl.[7] ..... G08G 1/00
(52) U.S. Cl. ..... 340/928; 455/63
(58) Field of Search ..... 340/928; 455/63, 455/361, 816, 899, 403, 402, 422, 517; 343/841, 361, 816

(56) References Cited

U.S. PATENT DOCUMENTS 3,783,414 A * 1/1974 Klein ..... 333/22
4,737,796 A * 4/1988 Bonebright ..... 343/782
4,941,207 A * 7/1990 Maeda ..... 455/617
5,406,275 A * 4/1995 Hassett ..... 340/933
5,812,080 A * 9/1998 Takahashi ..... 343/4
6,112,106 A * 8/2000 Crowley ..... 455/575
6,136,429 A * 10/2000 Saito ..... 428/323
6,214,454 B1 * 4/2001 Kanda ..... 428/294.7

FOREIGN PATENT DOCUMENTS

JP 3069341 5/2000

* cited by examiner

*Primary Examiner*—Anh La
(74) *Attorney, Agent, or Firm*—McDermott, Will & Emery

(57) ABSTRACT

The present invention intends to provide an electronic toll collection system for suppressing multi-path. For this end, the electronic toll collection system automatically collects tolls by establishing wireless communication between a roadside antenna 23 of a toll gate and a vehicle unit 33 installed in a traveling vehicle. It features a road-to-vehicle wireless communication zone of the tollgate covered with a structure 22 including radio wave absorbing material. The inner surface is preferably made from a radio wave absorbing member 11 including a mixture 13 of magnetic material and synthetic rubber. The roadside antenna 23 is installed inside the structure 22, thereby enabling the roadside antenna 23 to wireless communicate only with ETC vehicles traveling in the structure 22 and preventing multi-path between the roadside antenna 23 and vehicles traveling outside the structure 22 (or outside the communication zone).

19 Claims, 18 Drawing Sheets

52
51

Road Surface 54
53
52
51
53

52
500
120
54
53
56
55
Radio Wave Absorbing Panel
1000

ELECTRONIC TOLL COLLECTION SYSTEM

BACKGROUND OF THE INVENTION

The present invention relates generally to an electronic toll collection (ETC) system, more specifically to an improved tollgate construction capable of preventing multi-path.

In a conventional ETC system, a roadside antenna is installed in a tollgate for performing wireless communication with a vehicle unit and toll collection process against the ID of an IC card installed in the vehicle unit. For this end, the ETC system determines if vehicles passing through the tollgate are ETC vehicles equipped with ETC compatible vehicle units or non-ETC vehicles excluding ETC compatible vehicle units by confirming whether or not wireless communication is established between the roadside antenna of the tollgate and the vehicle units in the vehicles as disclosed in the specification of Japanese patent application no. 11-033340 (or 033340/99).

However, since such conventional ETC system utilizes high frequency such as, for example, 5·8 GHz microwave range for wireless communication between the tollgate and vehicles, it is possible that multi-path occurs in the wireless communication between the tollgate and vehicles because radio wave from the roadside antenna may be reflected by the roof of one of vehicles in a queue or the roof or other structures of the tollgate to reach other vehicles in the queue. Also, there is a possibility where radio wave radiated from the roadside antenna is reflected by the surface of an island and by the roof of the tollgate to cause multi-path between the tollgate and vehicles in adjacent queues.

Under such circumstances, when non-ETC vehicles travel in a particular wireless communication zone, such vehicles should be determined as non-ETC vehicles because no wireless communication is established between the tollgate and the vehicles. However, multi-path may establish wireless communication between the tollgate and other ETC vehicles outside the normal wireless communication zone, thereby making incorrect judgement of the non-ETC vehicles by a vehicle lane control apparatus.

SUMMARY OF THE INVENTION

It is therefore an object of the present invention to provide an electronic toll collection system capable of preventing the above mentioned multi-path problems. For this end, the present invention is an electronic toll collection system for automatically collecting toll by wireless communication between a roadside antenna installed in the tollgate and a vehicle unit in each vehicle. It features in covering at least ceiling portion of the wireless communication zone of a tollgate with a radio wave absorbing structure and installing the roadside antenna inside the structure.

Also, the present invention features in covering with radio wave absorbing material the entire or a part of the surfaces of the roof covering the wireless communication zone of the tollgate, side walls, signboards, vehicle detectors, antenna supports, islands and the road adjacent to the wireless communication zone.

Additionally, the present invention features in the provision of an interference radio wave radiation antenna other than the roadside antenna of the tollgate for invalidating any communication by the radio wave leaking outside the vehicle-to-road communication zone.

As a result of the foregoing arrangements, multi-path between the roadside antenna and vehicles traveling outside the communication zone is effectively prevented, thereby maintaining reliability of the ETC system.

DETAILED DESCRIPTION OF THE DRAWINGS

The above mentioned and other objects of the present invention will be apparent from the following descriptions made by reference to the accompanying drawings.

Figure 1:
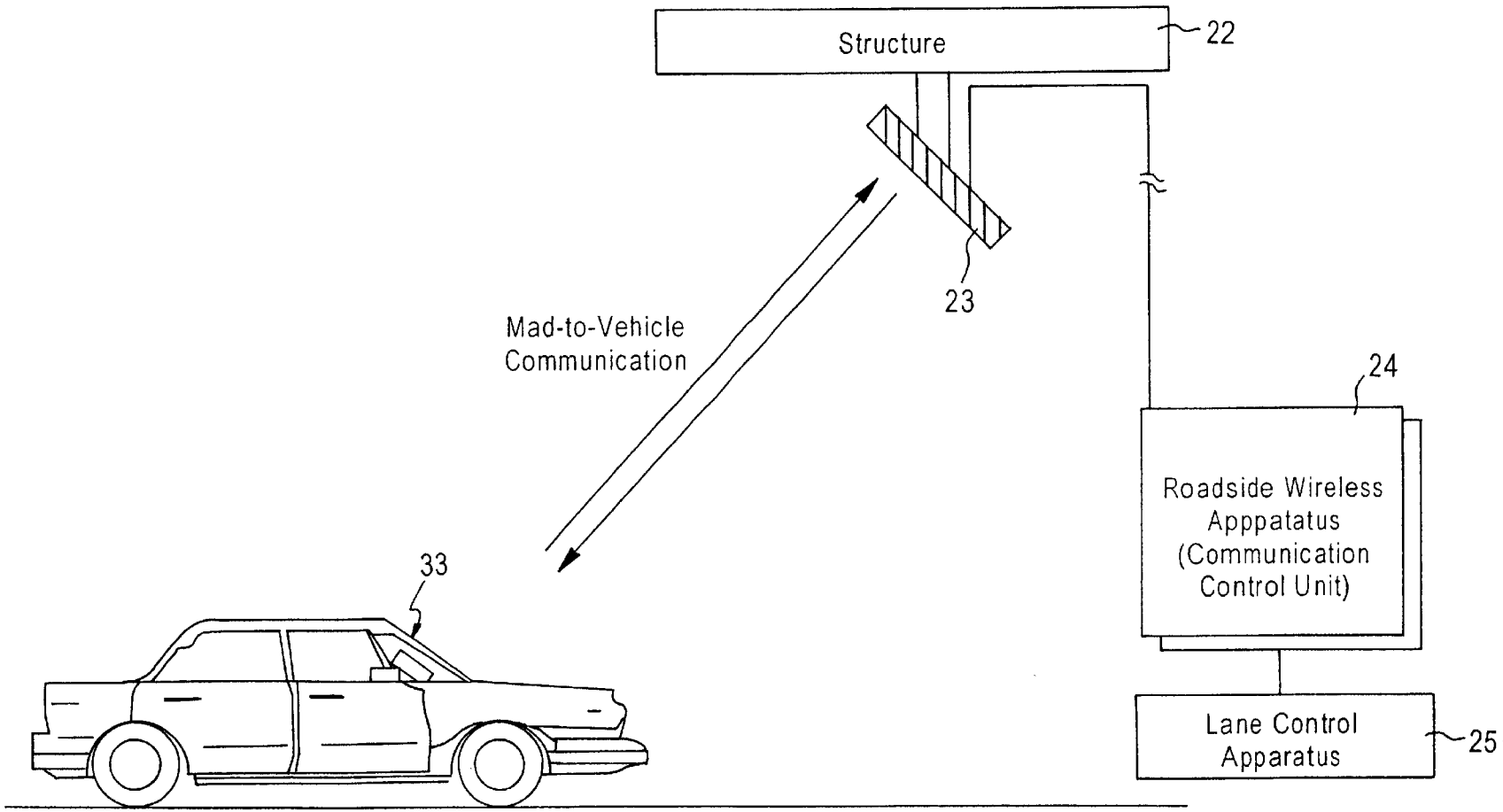
FIG. 1 is an illustration of a road-to-vehicle communication between the ETC roadside antenna and a vehicle unit.

FIG. 1 is a conventional ETC system comprising a roadside antenna 23 installed in a tollgate for wireless communication with a vehicle unit 33 installed in a vehicle traveling through the tollgate and for toll collection operation against the ID in an IC card set in the vehicle unit 33. Also shown in FIG. 1 are a structure 22 to which the roadside antenna 23 is installed, a roadside wireless apparatus (communication control unit) 24 connected to the antenna 23 and a lane control apparatus 25 connected to the roadside wireless apparatus 24.

The ETC system distinguishes ETC compatible vehicles (ETC vehicles) equipped with the ETC unit 33 from non-ETC vehicles excluding such ETC unit passing through the tollgate. As disclosed in the specification of Japanese patent application No. 11-033340 (or 033340/99) filed by the applicant of this patent application, such judgement is made based on whether or not the wireless communication is established between the roadside antenna 23 of the tollgate and the vehicle unit 33.

Figure 2:
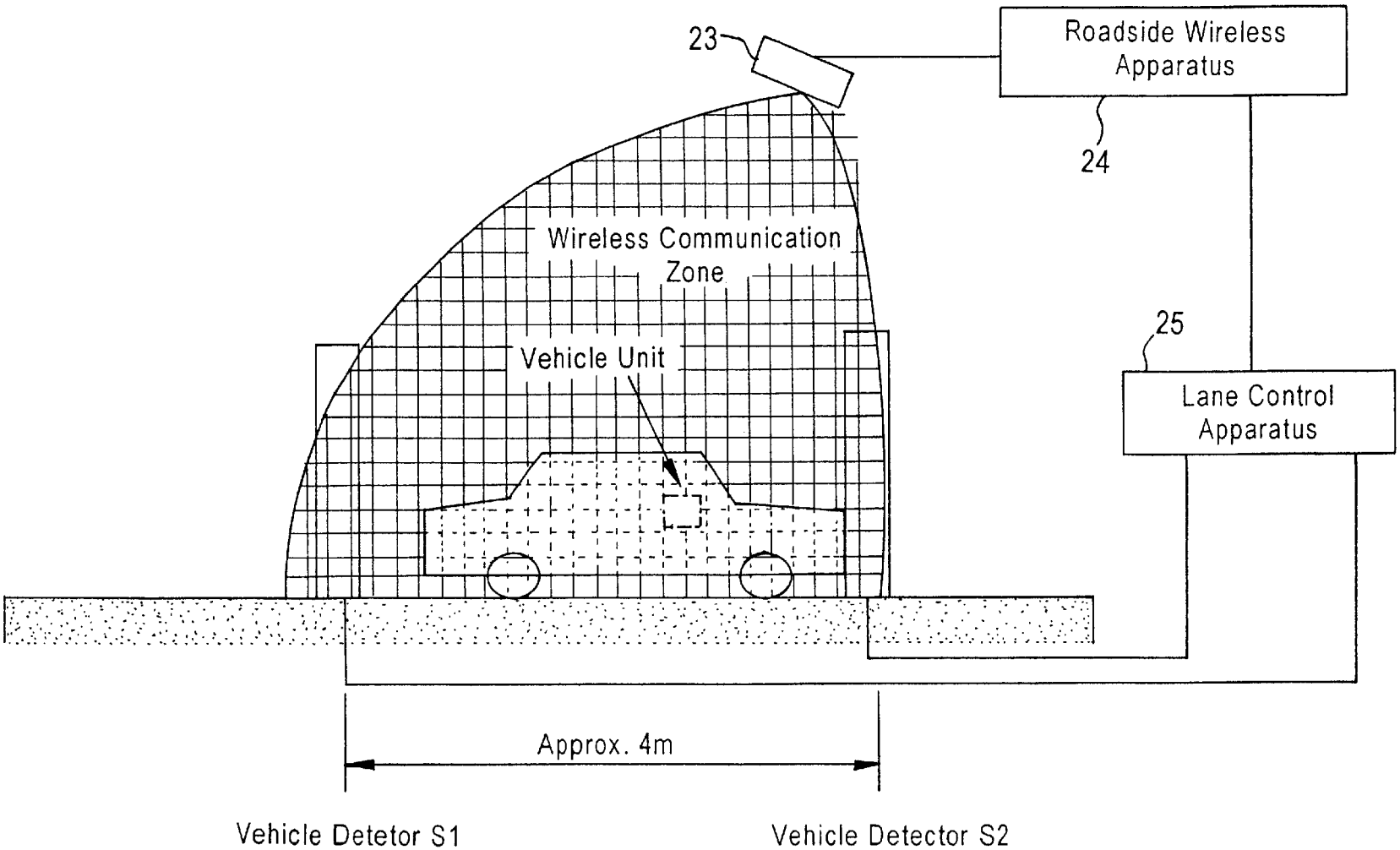
FIG. 2 shows the relationship between a first vehicle detector S1, a second vehicle detector S2, a roadside antenna and the wireless communication zone.

As shown in FIG. 2, a first vehicle detector S1 and a second vehicle detector S2 are typically positioned with about 4 meters distance therebetween for radiating directional radio wave from the roadside antenna 23 to establish a wireless communication zone between the two vehicle detectors S1,S2. The roadside antenna 23 starts radiating radio wave upon a vehicle entry detection signal from the first vehicle detector S1. When the vehicle travels 4 meters from the first vehicle detector S1, the roadside antenna 23 stops radiating the radio wave upon receiving a vehicle detection signal from the second vehicle detector S2. At this time, the lane control apparatus 25 checks whether or not the road-to-vehicle wireless communication is established, thereby determining the vehicle as an ETC vehicle if such communication is established but as a non-ETC vehicle if such communication is not established.

Figure 4:
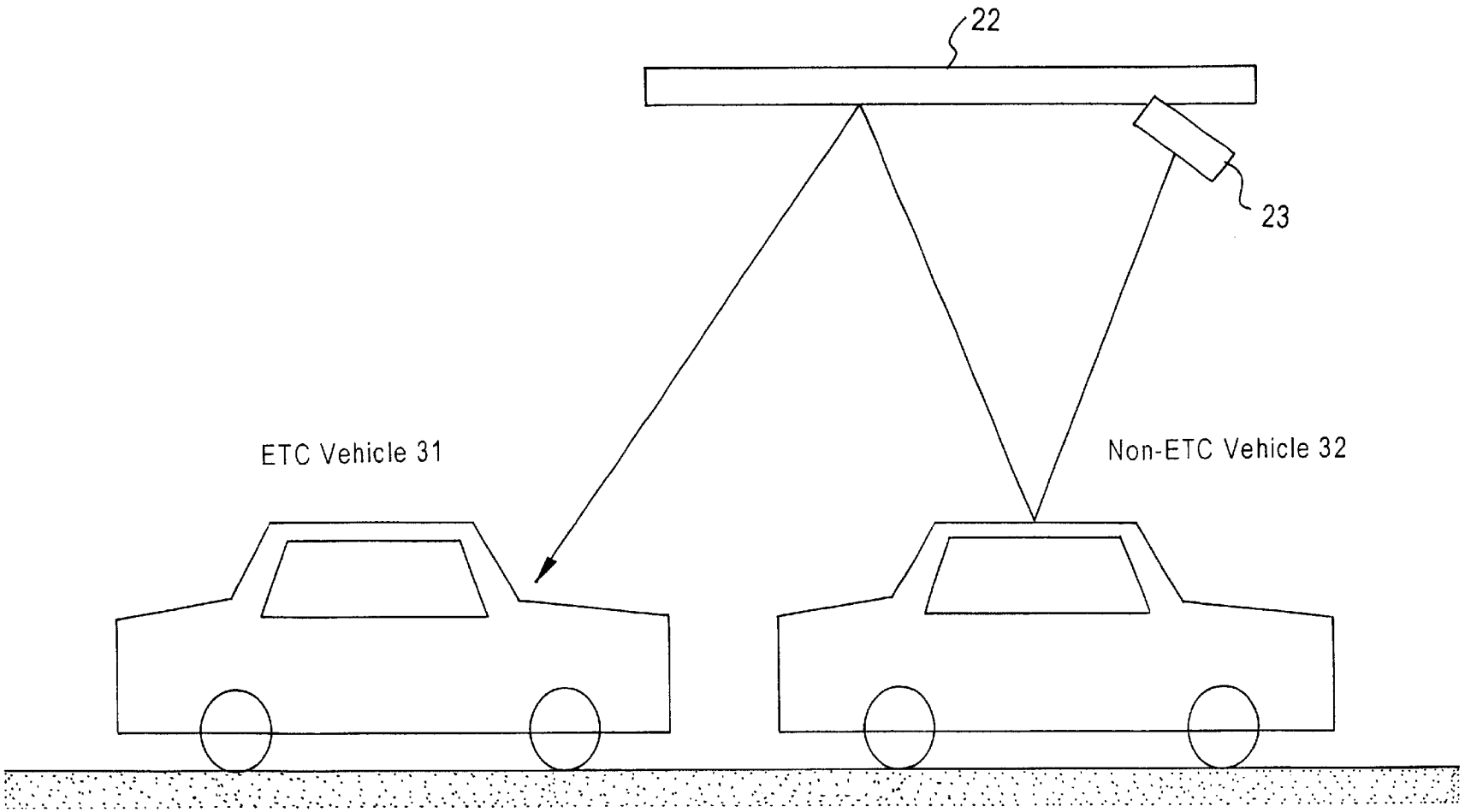
FIG. 4 shows how multi-path occurs between the roadside antenna and sub-sequent vehicles by reflecting the radio wave from the roadside antenna by the roof of a non-ETC vehicle and the roof of the tollgate.

However, the road-to-vehicle communication in the conventional ETC system utilizes 5.8 GHz microwave as the communication frequency. Such microwave from the roadside antenna 23 may be reflected by the roof of such vehicle or the structure 22 such as, for example, the roof of the tollgate as shown in FIG. 4, thereby causing multi-path between the roadside antenna 23 and the subsequent vehicle 31. Another possibility is that the radio wave from the roadside antenna 23 is reflected by the surface of an island (between adjacent lanes) and the structure 22 such as the roof of the tollgate as shown in FIG. 5, thereby causing multi-path between the vehicle 31 in the adjacent lane and the roadside antenna (ANT) 23.

Figure 5:
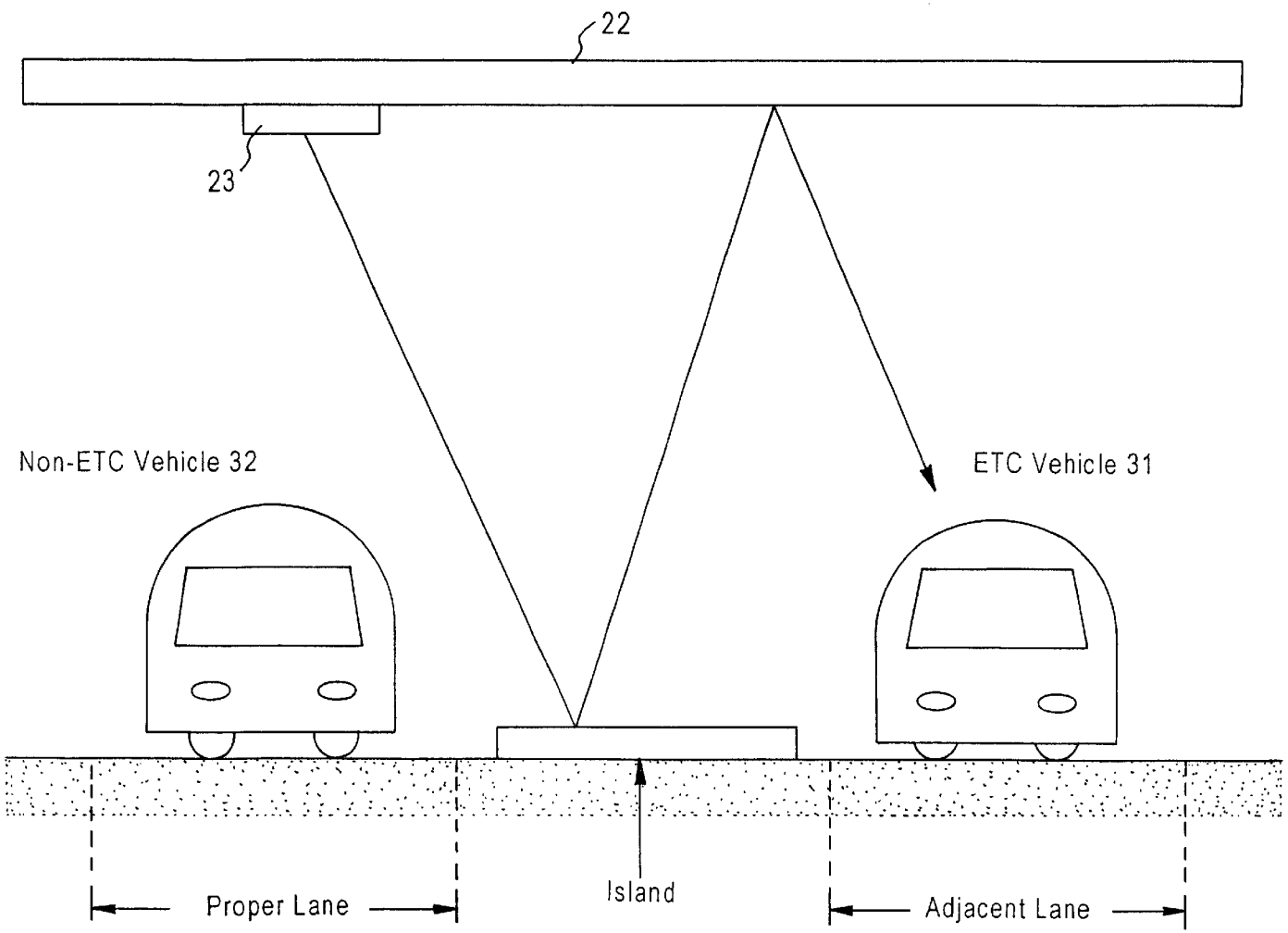
FIG. 5 shows how the multi-path occurs between vehicles in adjacent lanes by reflecting the radio wave from the roadside antenna by the surface of the island and the roof of the toll gate.

Under such circumstances, when a non-ETC vehicle 32 passes through the predetermined wireless communication zone as shown in FIGs. 4 and 5, the vehicle 32 should be determined as a non-ETC vehicle because no wireless communication is established between the ANT 23 and the non-ETC vehicle 32. However, when an ETC vehicle 31 happens to pass through the adjacent lane, multi-path occurs between the ANT 23 and the ETC vehicle 31 outside the wireless communication zone, thereby fooling the lane control apparatus 25 to make a false decision of the non-ETC vehicle 32.

Figures 3, 3A:
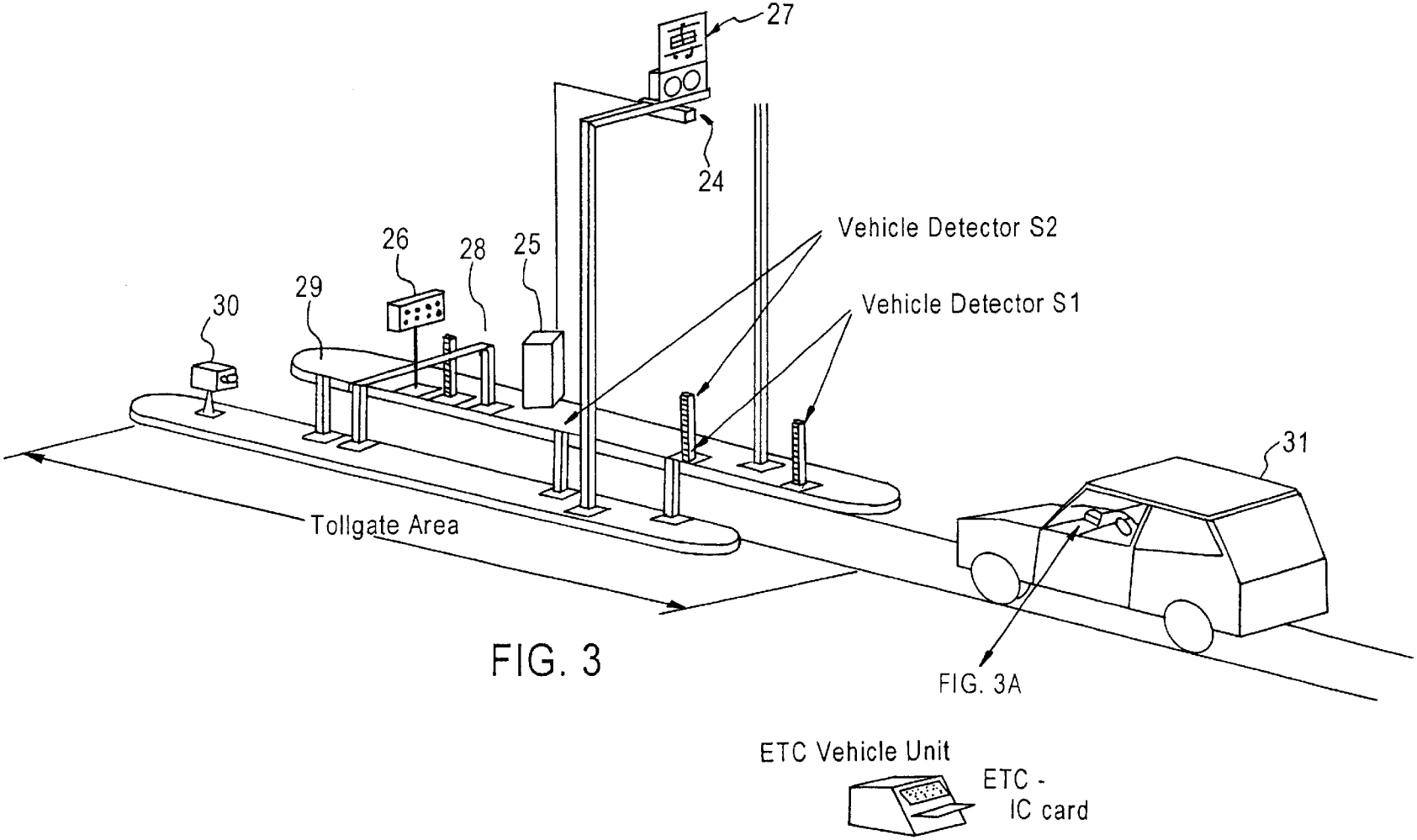
FIG. 3 is a conventional construction including a first vehicle detector S1 and a second vehicle detector for distinguishing ETC vehicles from non-ETC vehicles.

More recent studies show that the radio wave is reflected by not only the roof of the tollgate but also by a signboard 27, its support and the vehicle detectors S1, S2 in the tollgate as shown in FIG. 3, thereby causing multi-path. Moreover, if the tollgate is located under a raised highway, the bottom surface of such highway may act as a reflector of the radio wave, thereby causing multi-path.

The ETC system is based on the road-to-vehicle wireless communication. If multipath occurs between the ANT 23 and any vehicle other than the intended vehicle, correct toll collection is not effected, thereby significantly decreasing the system reliability.

In consideration of the above problems associated with the conventional ETC system, the present invention intends to overcome such problems in the following embodiments:

($1^{st}$ Embodiment)

Figure 6A:
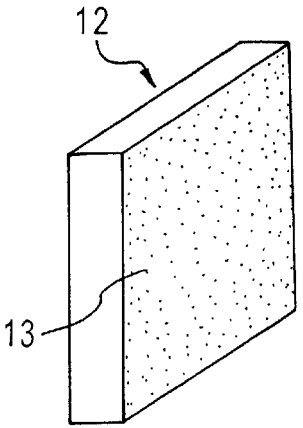
FIG. 6 is a construction for covering the road-to-vehicle wireless communication zone in a first embodiment of the present invention.
Figure 6:
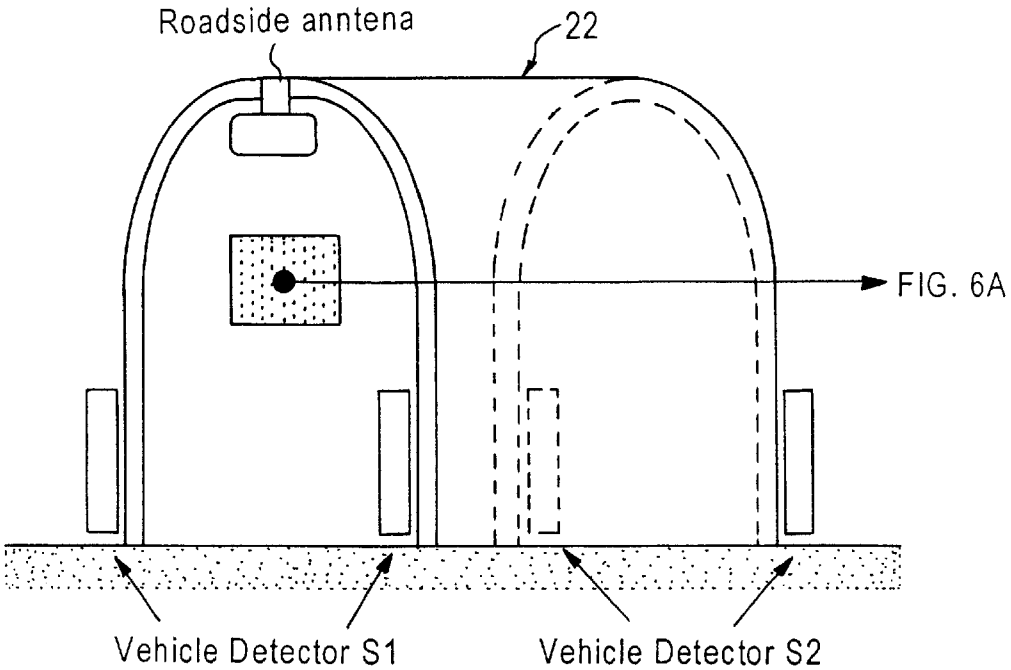

FIG. 6 shows a construction in which the road-to-vehicle wireless communication zone of a tollgate is covered with a semi-cylindrically domed structure 22. The semi-cylindrically domed structure 22 is disposed in such a manner to cover the road-to-vehicle wireless communication zone between a first vehicle detector S1 and a second vehicle detector S2. The inner surface of the semi-cylindrically domed structure 22 is disposed with a radio wave absorbing material 11 comprising a mixture 13 of magnetic material and synthetic rubber attached on the surface of a reflector 12. The roadside antenna 23 is, then, installed inside the domed structure 22

Such particular arrangement enables the roadside antenna 23 to establish wireless communication only with ETC vehicles traveling inside the domed structure 22, thereby effectively preventing multi-path between the roadside antenna 23 and outside the communication zone.

($2^{2}$Embodiment)

Figure 7A:
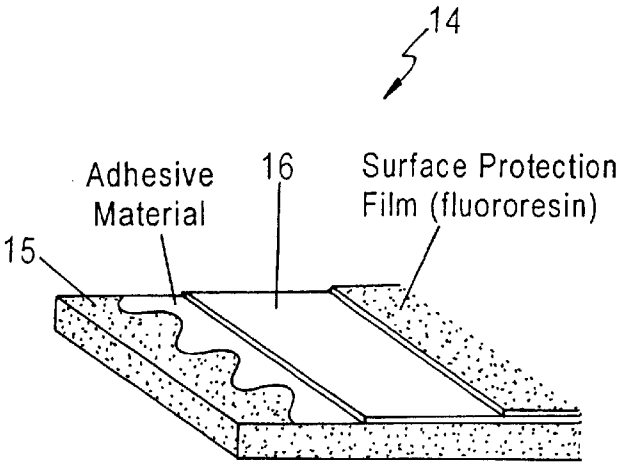
FIG. 7 is a construction for covering the road-to-vehicle wireless communication zone in a second embodiment of the present invention.
Figure 7:
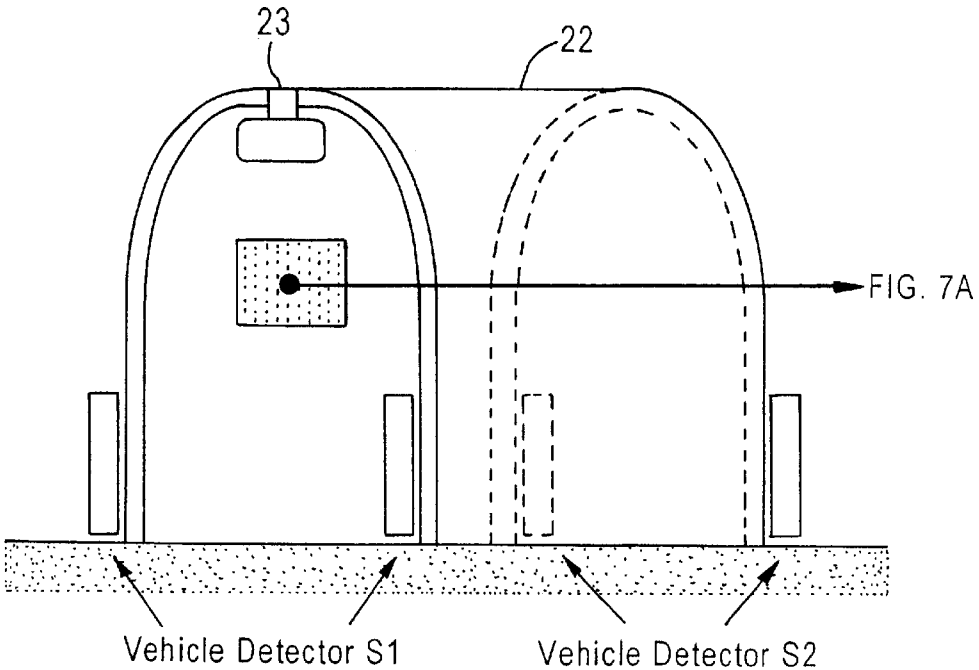

Illustrated in FIG. 7 is a construction to utilize a $\lambda/4$ type radio wave absorbing member 14 as the radio wave absorbing material. The road-to-vehicle wireless communication zone of a tollgate is covered with a semi-cylindrically domed structure 22 and a first vehicle detector S1 and a second vehicle detector S2 are disposed in the traveling direction of vehicles. The inner surface of the semi-cylindrically domed structure 22 is formed with the $\lambda/4$ type radio wave absorbing member 14 including a resistive film 16. The $\lambda/4$ type radio wave absorbing member 14 is made by coating adhesive material on a polyethylene sheet 15 to adhere the resistive film 16 and also covering the surface of the resistive film 16 with a surface protection film (fluororesin). The roadside antenna 23 is, then, installed inside the domed structure 22.

According to the above arrangement, the roadside antenna 23 is capable of wireless communicating only with ETC vehicles traveling through the domed structure 22, thereby effectively preventing multi-path between the roadside antenna 23 and any vehicles outside the domed structure 22(or outside the communication zone).

($3^{rd}$ Embodiment)

Figure 8A:
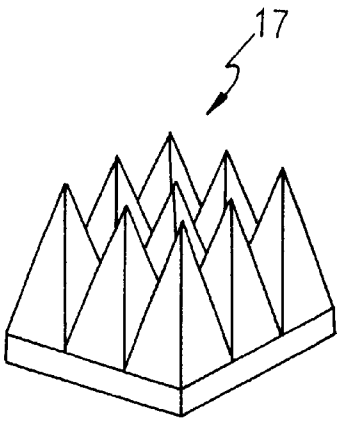
FIG. 8 is a construction for covering the road-to-vehicle wireless communication zone in a third embodiment of the present invention.
Figure 8:
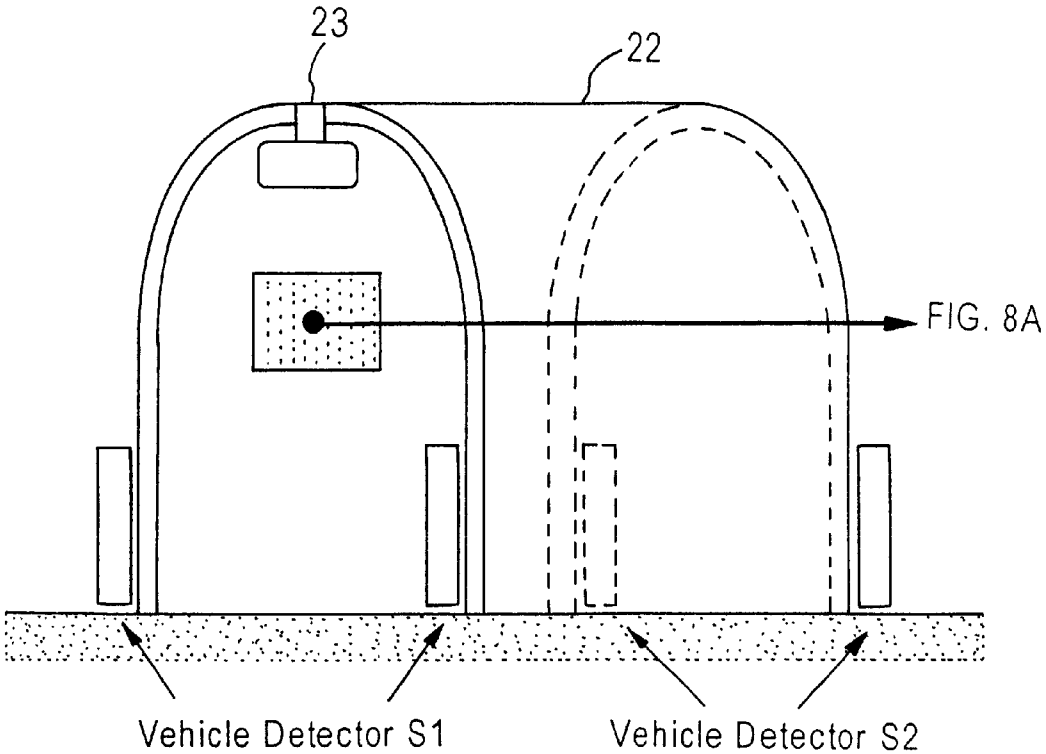

Illustrated in FIG. 8 is a radio wave absorbing member 17 formed with sharp projections. The road-to-vehicle wireless communication zone of the tollgate is covered with a semi-cylindrically domed structure 22 and both first and second vehicle detectors S1, S2 are disposed in the traveling direction of the vehicles. Then, the iner surface of the semi-cylindrically domed structure 22 is formed with the radio wave absorbing member 17 with sharp projections on a base of magnetic material. The roadside antenna 23 is, then, installed inside the domed structure 22.

This arrangement enables the roadside antenna 23 to wireless communicate only with ETC vehicles traveling inside the domed structure 22, thereby effectively preventing multi-path communication with vehicles traveling outside the domed structure 22 (or outside the communication zone)

($4^{th}$ Embodiment)

Figure 9A:
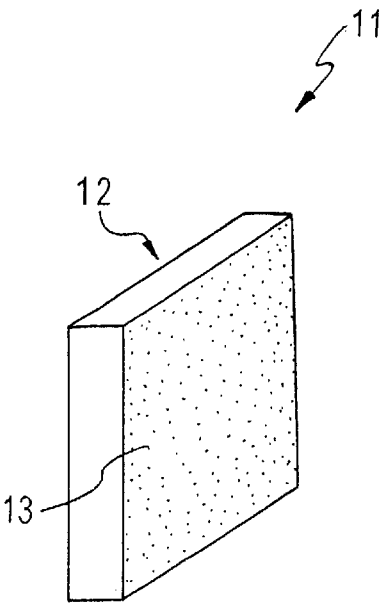
FIG. 9 is a construction for covering the road-to-vehicle wireless communication zone in a fourth embodiment of the present invention.
Figure 9:
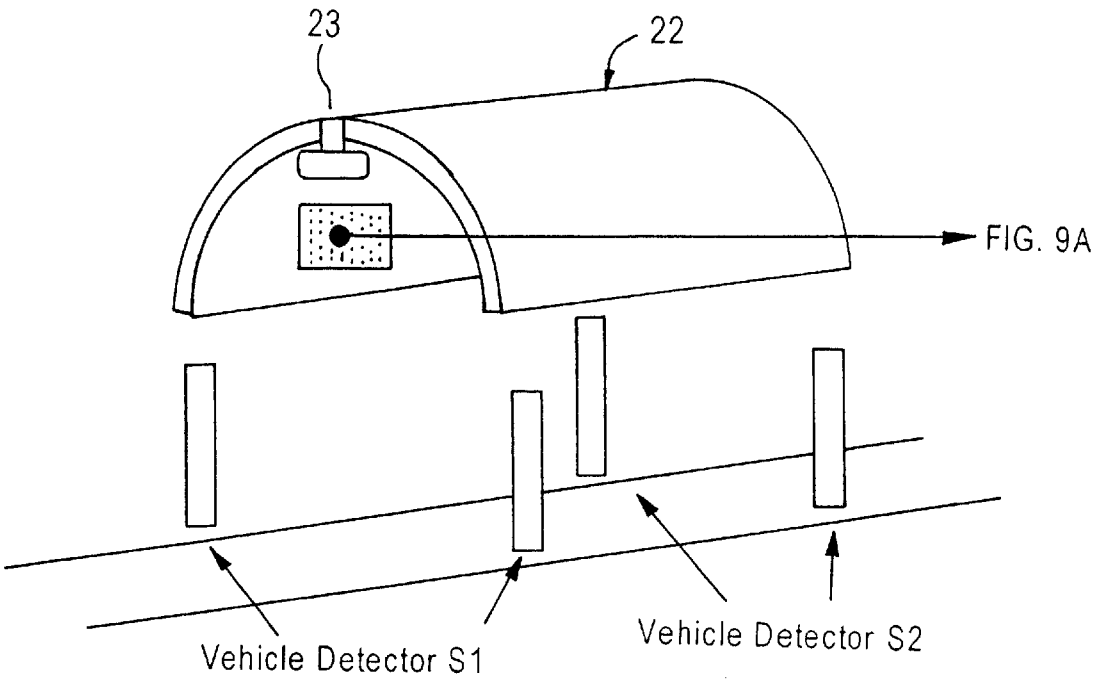

Illustrated in FIG. 9 is a construction covering the road-to-vehicle wireless communication zone with an arcuate structure 22. The road-to-vehicle wireless communication zone of a tollgate is covered with the arcuate structure 22 at the ceiling and also disposed are a first vehicle detector S1 and a second vehicle detector S2 in the traveling direction of the vehicles. Also, the inner surface of the arcuate structure 22 is formed with a radio wave absorbing member 11 comprising a mixture 13 of magnetic material and synthetic rubber attached onto a reflector 12. Additionally, a roadside antenna 23 is installed inside the arcuate structure 22. Such arrangement enables the roadside antenna 23 to wireless communicate only with ETC vehicles traveling under the arcuate structure 22, thereby preventing multi-path between the roadside antenna 23 and vehicles traveling outside the arcuate structure 22 (or outside the communication zone).

($5^{th}$ Embodiment)

Figure 10A:
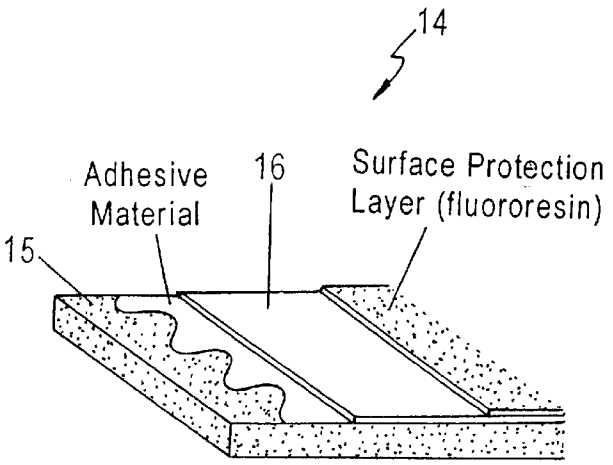
FIG. 10 is a construction for covering the road-to-vehicle wireless communication zone in a fifth embodiment of the present invention.
Figure 10:
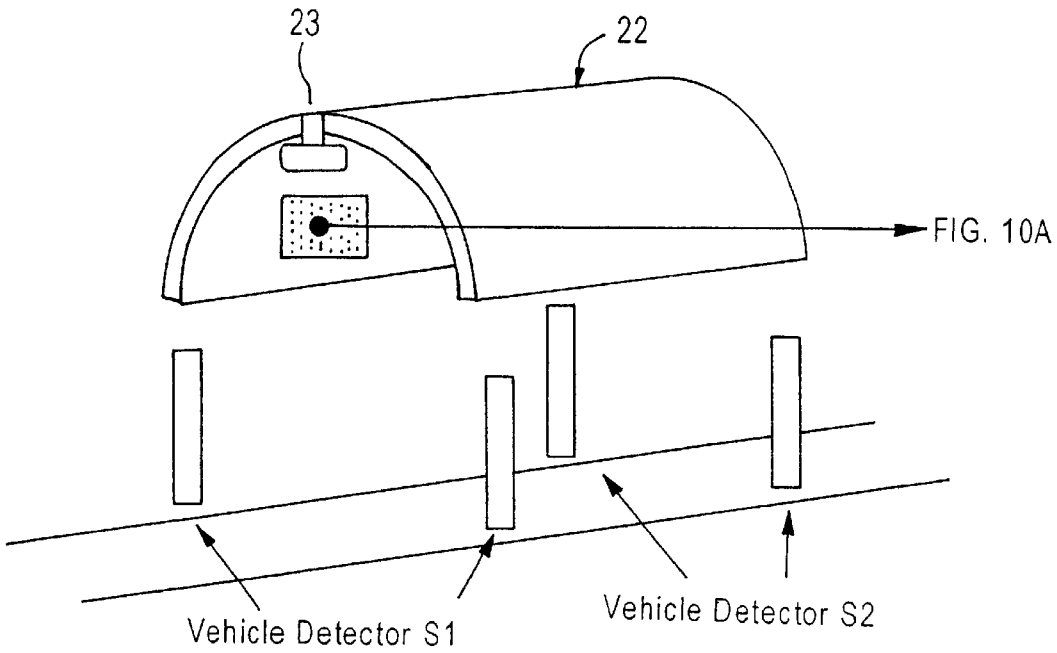

Illustrated in FIG. 10 is a construction to provide an inner layer of a λ/4 type radio wave absorbing member 14 to an arcuate structure 22. A road-to-vehicle wireless communication zone of a tollgate is covered with the arcuate structure 22 at the ceiling and disposed are a first vehicle detector S1 and a second vehicle detector S2 in the traveling direction of the vehicles. The inner layer of the arcuate structure 22 is formed with the λ/4 type radio wave absorbing member 14 using a resistive film 16. The λ/4 type radio wave absorbing member 14 is made by coating adhesive material on a polyethylene sheet 15 to adhere the resistive film 16 and then covering the resistive film 16 with surface protection film (fluororesin). And then the roadside antenna 23 is installed inside the arcuate structure 22.

The foregoing arrangement enables the roadside antenna to wireless communicate only with ETC vehicles traveling under the arcuate structure 22, thereby preventing multi-path between the roadside antenna 23 and vehicles-traveling outside the arcuate structure 22 (or outside the communication zone).

($6^{th}$ Embodiment)

Figure 11A:
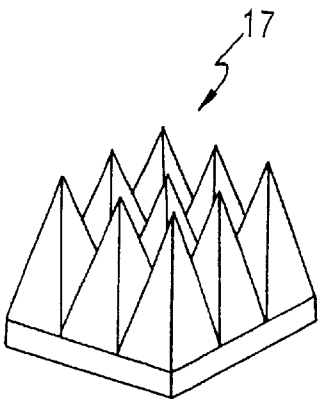
FIG. 11 is a construction for covering the road-to-vehicle wireless communication zone in a sixth embodiment of the present invention.
Figure 11:
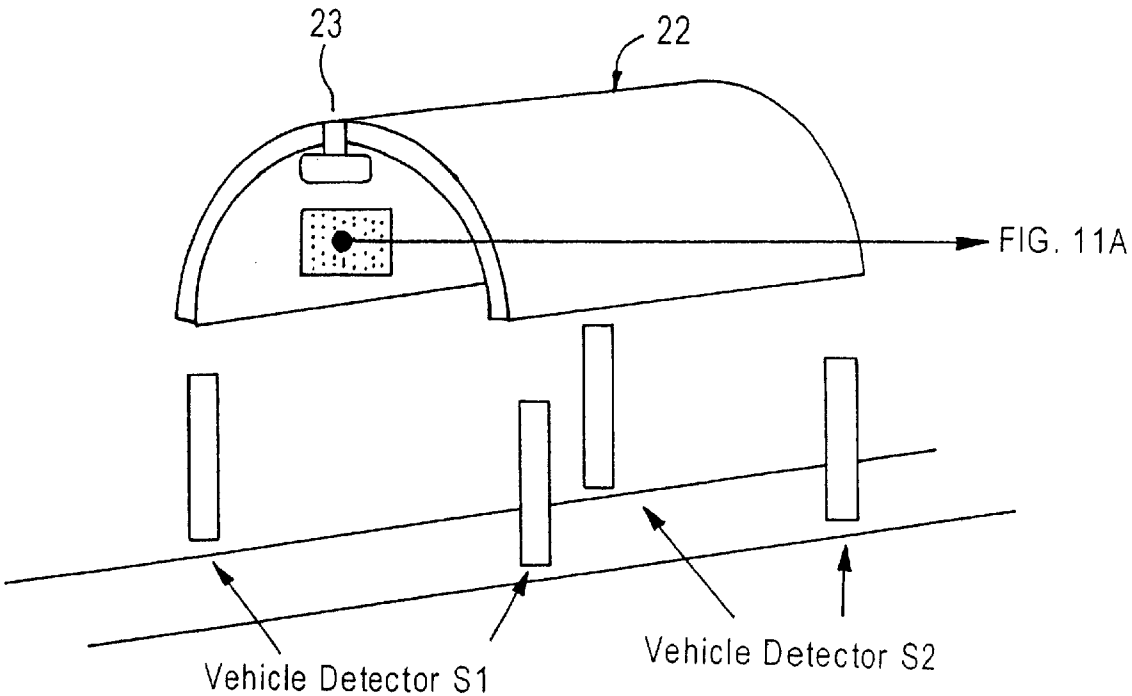

Illustrated in FIG. 11 is a construction of providing an inner layer of an arcuate structure 22 formed with a radio wave absorbing member 17 having sharp projections. A road-to-vehicle wireless communication zone of a tollgate is covered with the arcuate structure 22 at the ceiling and disposed are a first vehicle detector S1 and a second vehicle detector S2 in the traveling direction of the vehicles. The inner surface of the arcuate structure 22 is formed with the radio wave absorbing member 17 based on magnetic material having sharp projections on the surface thereof. Also installed inside the arcuate structure 22 is the roadside antenna 23.

The foregoing arrangement enables the roadside antenna 23 to perform wireless communication only with ETC vehicles traveling under the arcuate structure 23, thereby preventing multi-path with vehicles traveling outside the arcuate structure 22 (or outside the communication zone)

($7^{th}$ Embodiment)

Figure 12A:
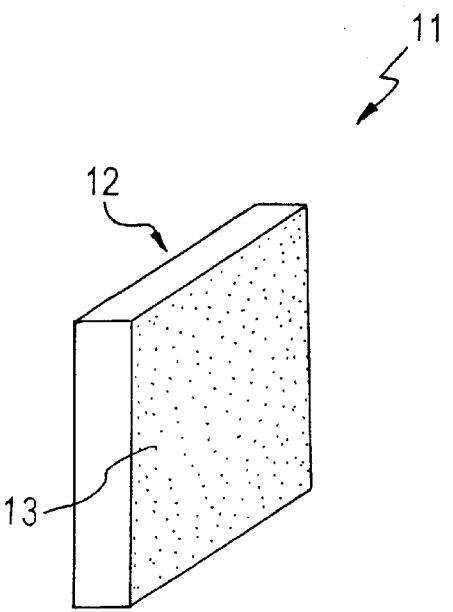
FIG. 12 is a construction for covering the road-to-vehicle wireless communication zone in a seventh embodiment of the present invention.
Figure 12:
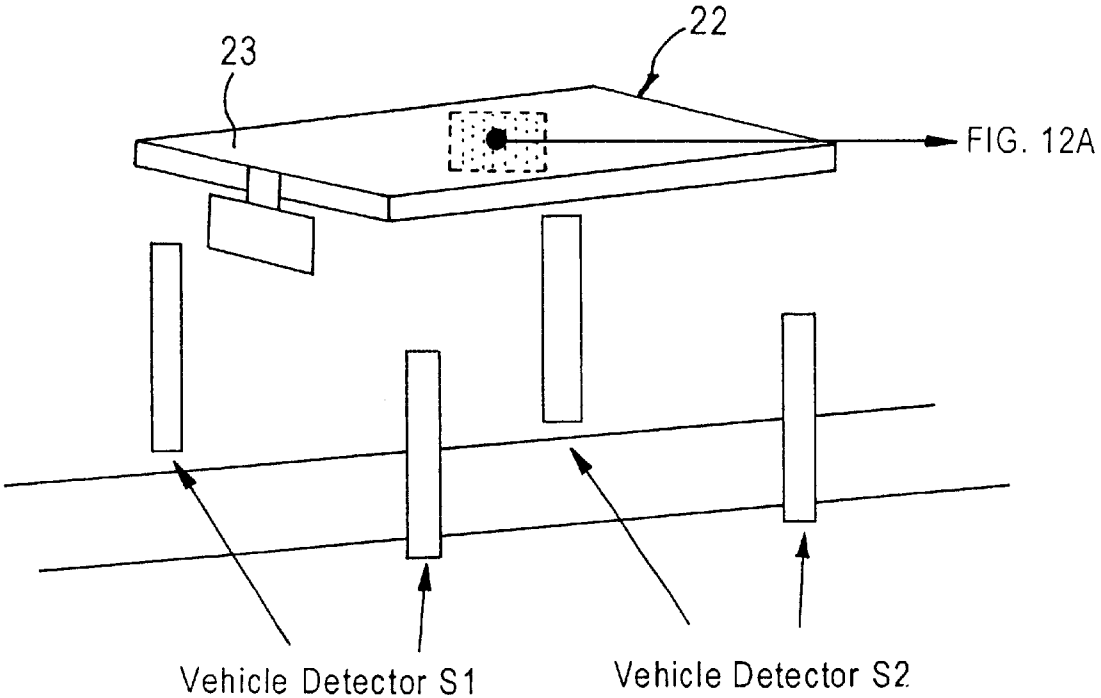

Illustrated in FIG. 12 is a construction for covering a road-to-vehicle wireless communication zone with a flat structure 22. The road-to-vehicle wireless communication zone of a tollgate is covered with the flat structure 22 at the ceiling and also disposed are a first vehicle detector S1 and a second vehicle detector S2 in the traveling direction of the vehicles. The outer surface of the flat structure 22 is, then, formed with a radio wave absorbing member 11 made by adhering a mixture 13 of magnetic material and synthetic rubber on a reflector 12. Finally, a roadside antenna 23 is installed below the flat structure 22.

The foregoing arrangement enables the roadside antenna 23 to wireless communicate only with ETC vehicles traveling through the wireless communication zone, thereby preventing multi-path with vehicles traveling outside the wireless communication zone.

($8^{th}$ Embodiment)

Figure 13A:
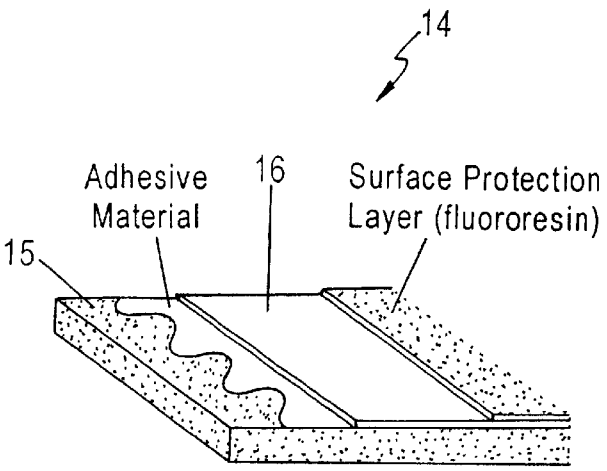
FIG. 13 is a construction for covering the road-to-vehicle wireless communication zone is an eighth embodiment of the present invention.
Figure 13:
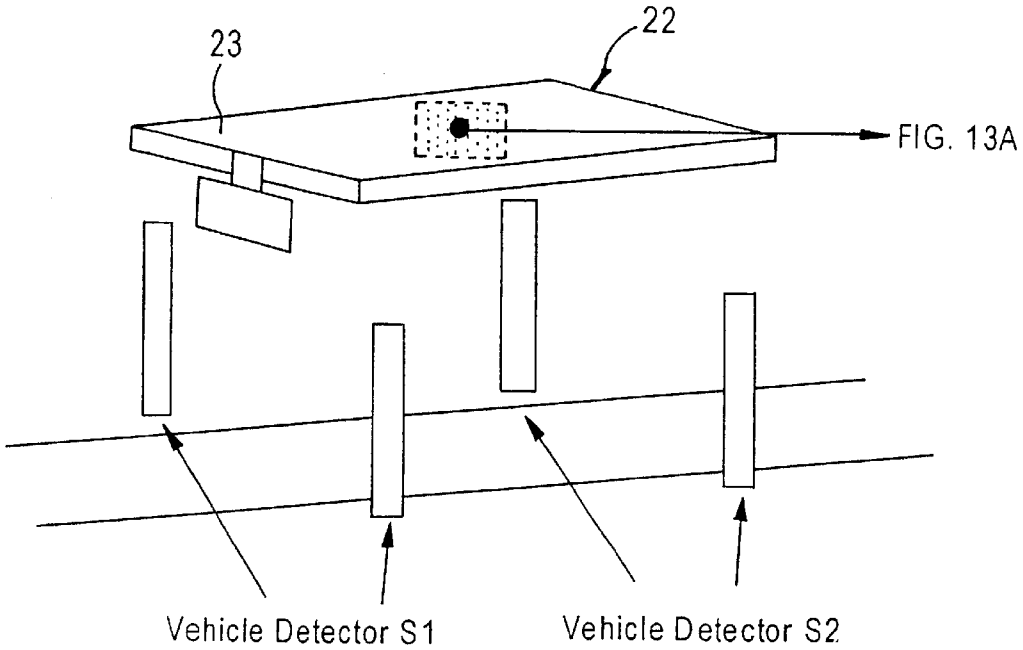

Illustrated in FIG. 13 is a construction of the inner layer of a flat structure 22 formed with a λ/4 type radio wave absorbing member 11. A road-to-vehicle wireless communication zone is covered with the flat structure 22 at ceiling and also disposed in the traveling direction of the vehicles are a first vehicle detector S1 and a second vehicle detector S2. Also, the surface of the flat structure 22 is formed with the λ/4 type radio wave absorbing member 14 utilizing a resistive film 16. The λ/4 type radio wave absorbing member 14 is made by coating adhesive material on a polyethylene sheet 15 to adhere the resistive film 16 and then the resistive film 16 is covered with a surface protection film (fluororesin). Finally, a roadside antenna 23 is installed under the flat structure 22.

The foregoing arrangement enables the roadside antenna 23 to wireless communicate only with ETC vehicles traveling in the wireless communication zone, thereby preventing multi-path with vehicles traveling outside the wireless communication zone.

($9^{th}$ Embodiment)

Figure 14A:
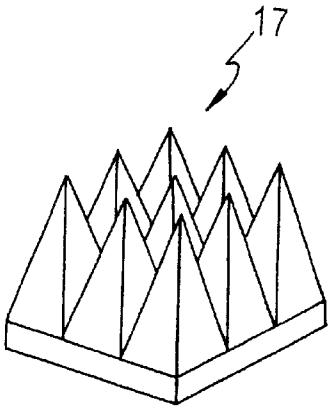
FIG. 14 is a construction for covering the road-to-vehicle wireless communication zone in a ninth embodiment of the present invention.
Figure 14:
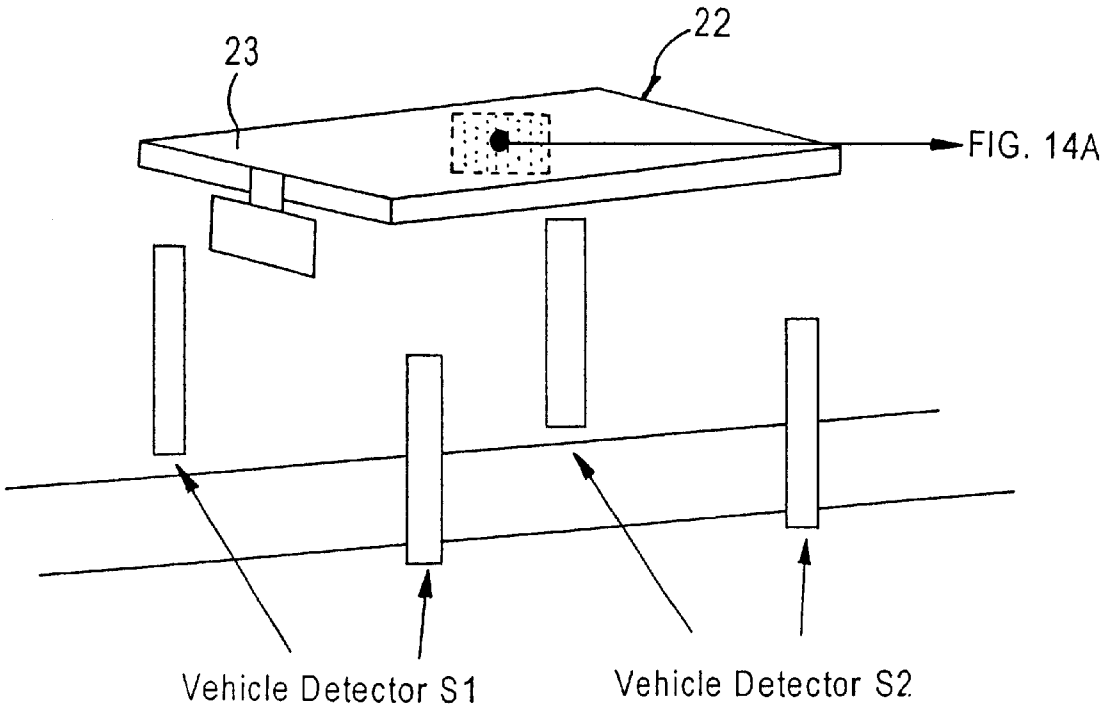

Illustrated in FIG. 14 is a construction of a flat structure 22 with the inner layer made of a radio wave absorbing member 17 having sharp projections. A road-to-vehicle wireless communication zone of a tollgate is covered with the flat structure 22 at the ceiling and also disposed are a first vehicle detector S1 and a second vehicle detector S2 in the traveling direction of the vehicles. The surface layer of the flat structure 22 is formed with a magnetic material based on the radio wave absorbing member 17 having sharp projections on the surface thereof. Finally, a roadside antenna 23 is installed under the flat structure 22.

The foregoing arrangement enables the roadside antenna 23 to wireless communicate only with ETC vehicles traveling in the wireless communication zone, thereby preventing multi-path with vehicles traveling outside the wireless communication zone.

($10^{th}$ Embodiment)

In a $_{10}$th embodiment, a radio wave absorbing member is made in a multiple layer construction. In case of the multiple layer radio wave absorbing member, radio wave absorbing layers cooperate with one another to provide improved overall radio wave absorbing characteristic. Also, mechanical strength can be maintained when the radio wave absorbing member is formed in a sheet or a panel.

Figures 15A, 15B, 15C, 15D:
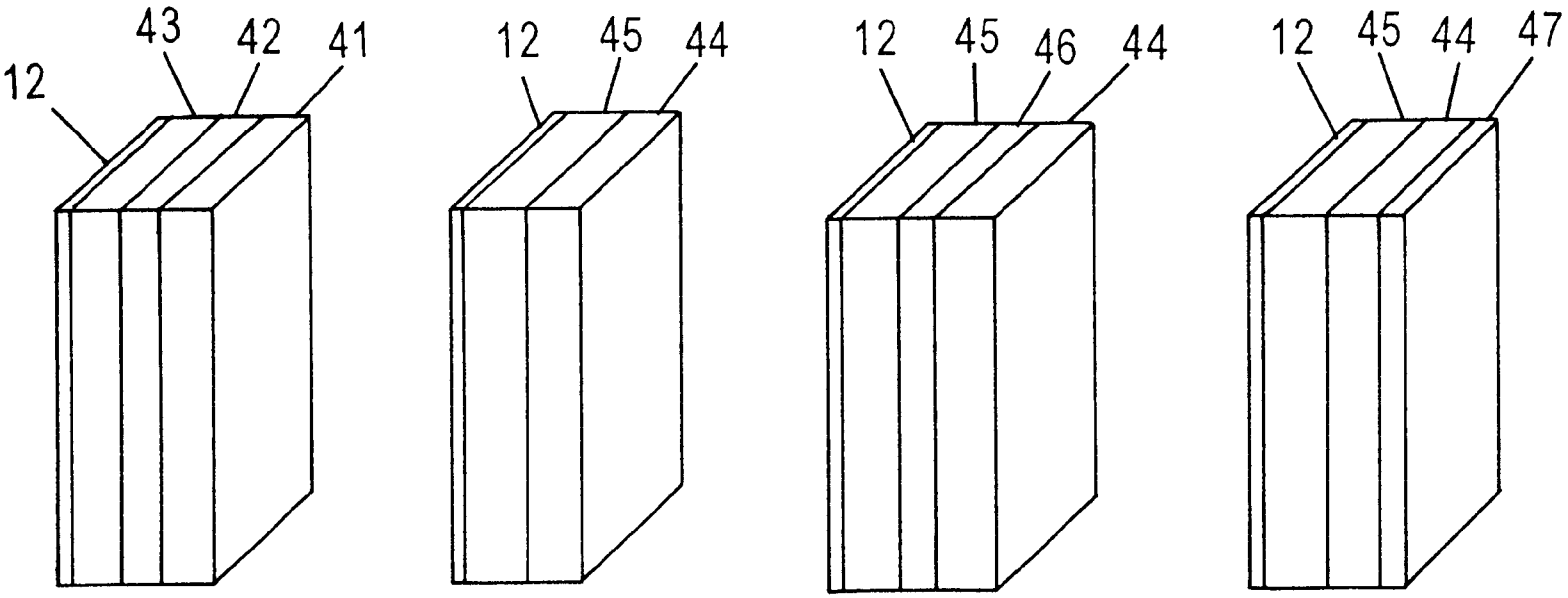
FIG. 15 is a construction of a radio wave absorbing member in a tenth embodiment of the present invention.

FIG. 15(*a*) shows a 3-layer radio wave absorbing member laminating a first magnetic layer 43, an electrically conductive layer 42 and a second magnetic layer 41 on a reflector 12. The first and second magnetic layers 41 and 43 are made by densely dispersing powders of magnetic material such as Fe-Si-Al alloy in a polymer. The 3-layer radio wave absorbing member exhibits excellent attenuation characteristic improved by about 20 dB as compared with a single layer radio wave absorbing member.

Shown in FIG. 15(*b*) is a double layer radio wave absorbing member made by laminating on a reflector 12 a first foamed electrically conductive polyethylene layer 45 and a second foamed electrically conductive polyethylene layer 44.

Shown in FIG. 15(*c*) is a 3-layer radio absorbing member made of a first foamed electrically conductive polyethylene layer 45 and a second foamed electrically conductive polyethylene layer 44 sandwiching a foamed polyethylene layer 46 therebetween. Radio wave absorbing characteristic of the double layer radio wave absorbing member in FIG. 15(*b*) is 20dB and significantly better than that (15 dB) of the single layer radio wave absorbing member.

On the other hand, the 3-layer radio wave absorbing member in FIG. 15(*c*) has the same radio wave absorbing characteristic as the double layer radio wave absorbing member but has a broader band radio wave absorbing characteristic because of absorbing lower frequency radio wave.

Shown in FIG. 15(*d*) is a multi-layer radio wave absorbing member including a surface protection layer 47 on the front surface thereof. The surface protection layer 47 is made from a polycarbonate plate of 1–5 mm in thickness to prevent the radio wave absorbing layers 44,45 from surface contamination or damages. The surface protection layer 47 thicker than the above may adversely affect the radio wave attention characteristic.

These multi-layer radio wave absorbing members can replace the radio wave absorbing members for covering the road-to-vehicle wireless communication zone of a tollgate in the above $1^{st}$ through $9^{th}$ embodiments.

In the above mentioned $1^{st}$ through $10^{th}$ embodiments, at least ceiling portion of the road-to-vehicle wireless communication zone is covered with a suitable structure having radio wave absorbing characteristic, thereby enabling the roadside antenna to wireless communicate with ETC vehicles traveling in the structure. However, the present invention can be applied to the ETC system in a roofed gate or a tollgate under a raised highway as described hereunder.

In case of the road-to-vehicle wireless communication zone of a tollgate built under a roof or a raised highway, the radio wave absorbing members as described in the above embodiments can be placed on the lower surface of the roof or the highway. The radio wave absorbing member may be in form of a sheet to be attached to the roof or the like, or in form of a panel to be installed using mounting fixtures.

The area of the radio wave absorbing member to be disposed on a roof should be wide enough to cover substantially the entire road-to-vehicle wireless communication zone if it is for a single lane. In case of plural lanes, the area of the radio wave absorbing member should have the width equal to the width of a lane and the adjacent island and the length equal to the road-to-vehicle wireless communication zone in the traveling direction of the vehicles.

Figures 16A, 16B, 16C:
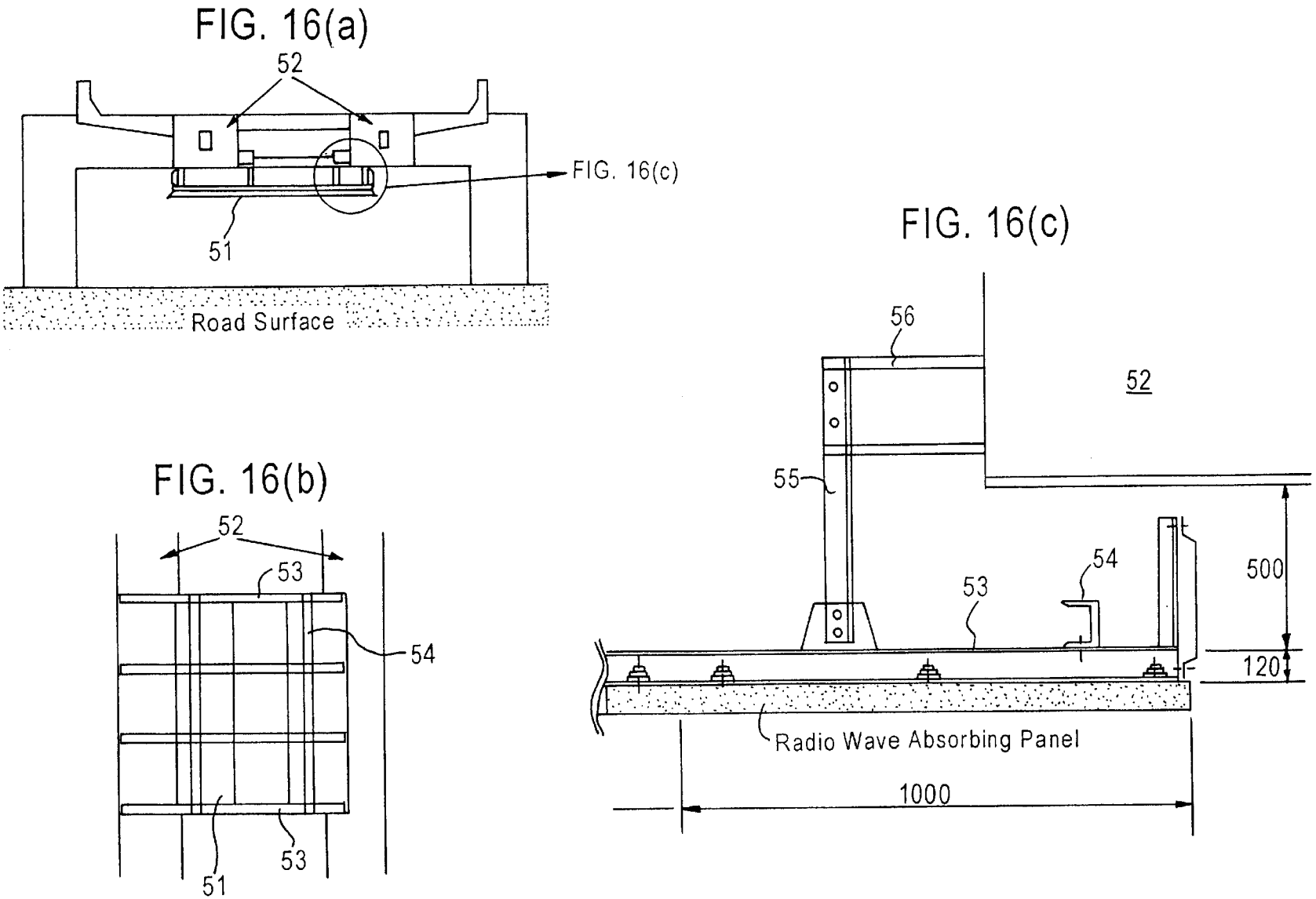
FIG. 16 shows how the radio wave absorbing panel is mounted in the embodiment of the present invention.

Illustrated in FIG. 16 is an example of mounting panels of radio wave absorbing member 51 on columns 52 of a raised highway. FIG. 16(*a*) is a side view, FIG. 16(*b*) is a plan view and FLG. 16(*c*) shows a detailed mounting in FIG. 16(*a*).

Each radio wave absorbing member 51 is in a form of an elongate panel. Radio wave absorbing panels 51 of any desired area are obtained by disposing a plurality of such panels to be mounted by four horizontal beams 53 and also mounting two vertical beams 54 to the horizontal beams 53. The radio wave absorbing panels 51 are secured to beams 56 extending from the columns 52 of the raised highway using a support member 55. This particular mounting technique realizes a ceiling type structure above the roadto-vehicle wireless communication zone.

The roadside antenna is installed below the radio wave absorbing member by mounting onto the roof or the radio wave absorbing panels 51 or by mounting on a separate antenna supporting structure. Other than the roof of a tollgate, it is possible to attach the radio wave absorbing member or wrap on the entire surface or a part of the surface of structure constituting side walls, the island, the support for the antenna, the signboard (see 27 in FIG. 3) of the tollgate, indicators, vehicle detectors, etc. in order to suppress the reflection of radio wave and also multi-path. In case where a tollgate has no roof, multi-path may occur as a result of reflection of radio wave by side walls, islands, antenna supports, tollgate signboards, indicators, vehicle detectors, etc. However, such multi-path may be eliminated by covering them with these radio wave absorbing members. It is also possible to apply a radio wave absorbing coating directly on a selected area. Also, a similar effect is achieved by using a radio wave disturbance structure such as wave-shaped metal plate or the like as a replacement of the radio wave absorbing member.

($11^{th}$ Embodiment)

Figure 17:
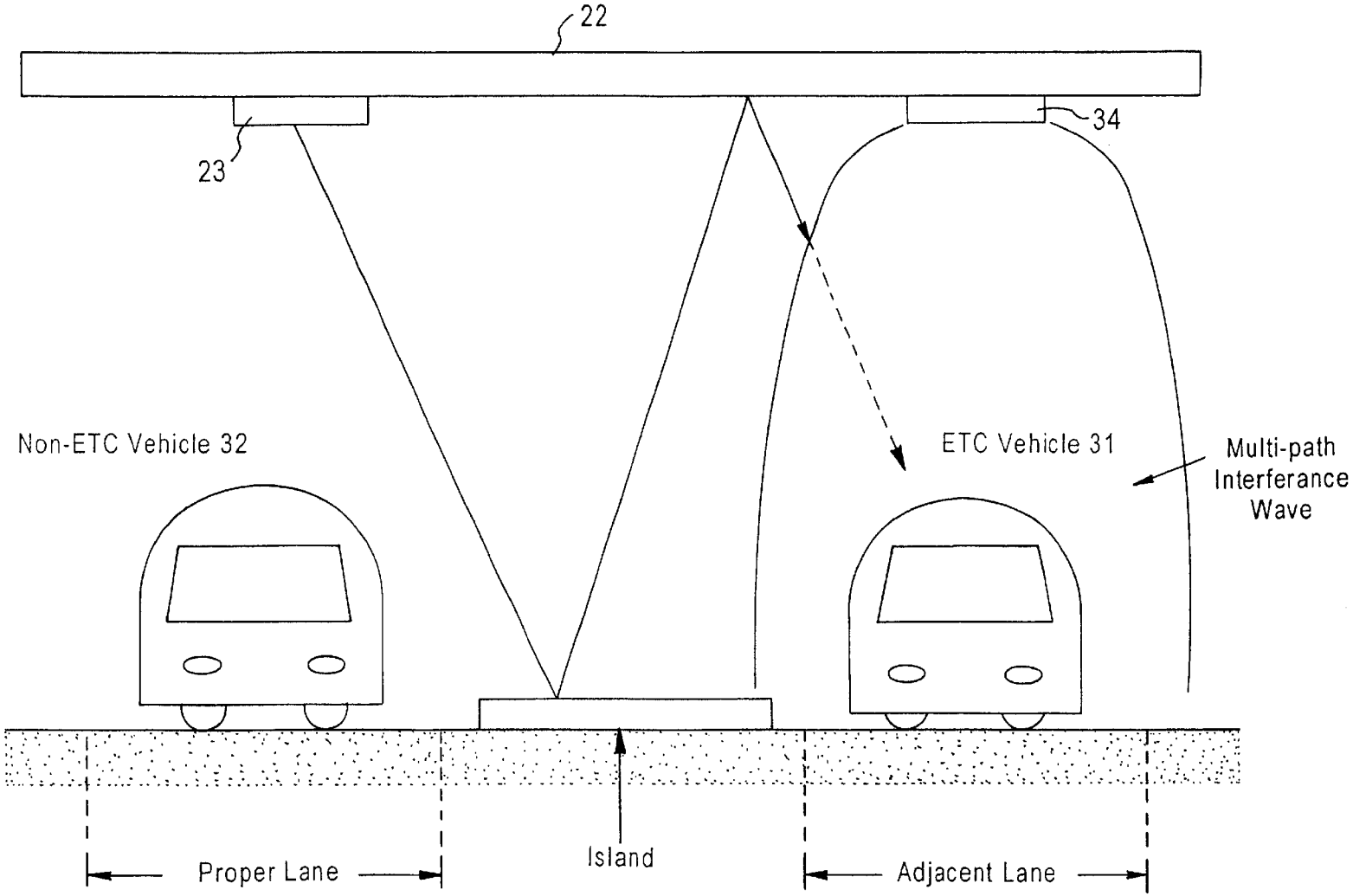
FIG. 17 shows multi-path prevention means in an eleventh embodiment of the present invention.

In an $11^{th}$ embodiment, multi-path is prevented by radiating multi-path interference radio wave. Illustrated in FIG. 17 is an arrangement to prevent the radio wave of the adjacent lane from entering by radiating multi-path interference radio wave. The radio wave radiated from the roadside antenna 23 is reflected by the surface of an island (between adjacent lanes) and a structure 22 such as the roof of a tollgate to leak into the adjacent lane. However, in this embodiment, multi-path is invalidated by radiating a multi-path interference radio wave from a multi-path interference wave radiation antenna 34. Such multi-path interference wave is radiated to cover the area of the adjacent lane.

Figure 18:
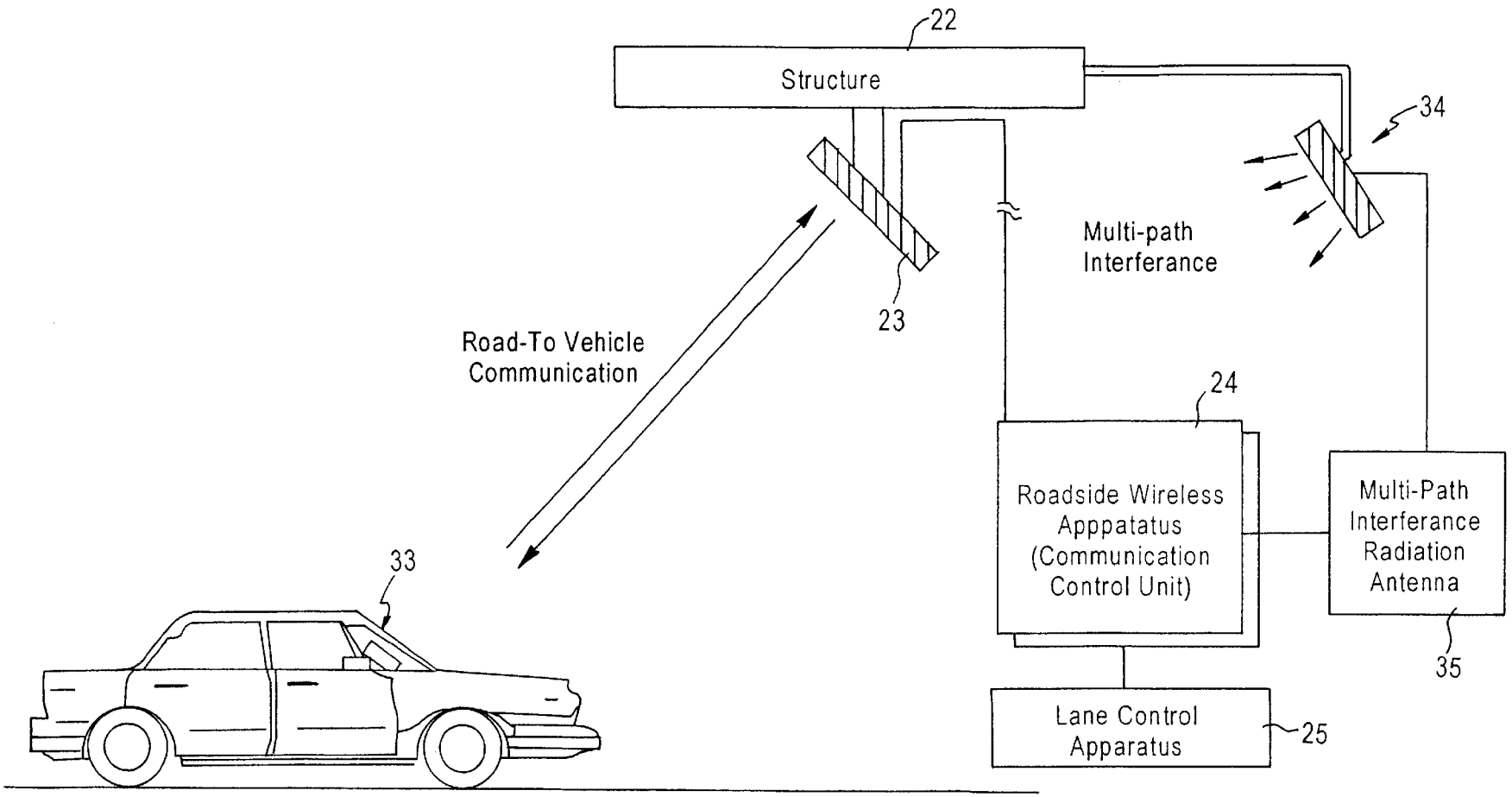
FIG. 18 shows an interference radio wave radiation apparatus in the eleventh embodiment of the present invention.

As shown in FIG. 18, the apparatus to prevent multi-path by the interference wave comprises a roadside antenna 23 installed in one lane of a tollgate, a multi-path interference wave radiation apparatus 35 for radiating the corresponding radio wave from the multi-path interference wave radiation antenna 34, a roadside wireless control apparatus (communication control section) 24 for communication controlling the roadside antenna 23 and also controlling the multi-path interference wave radiation apparatus 35, and a lane control apparatus for toll collection operation.

In this apparatus, when a vehicle travels through the lane equipped with the roadside antenna 23, the roadside wireless control apparatus (communication control section) 24 performs wireless communication with the vehicle unit 23 installed in the vehicle by way of the roadside antenna 23 in response to the instructions from the lane control apparatus 25. The acquired information is, then, transferred to the lane control apparatus 25 which performs toll collection operation against the ID of an IC card set in the vehicle unit 33. In wireless communication, the roadside wireless control apparatus (communication control section) 24 simultaneously controls the multi-path interference wave radiation apparatus 35 to radiate multi-path interference radio wave from the multi-path interference wave radiation antenna 34.

In this arrangement, the multi-path interference wave radiation antenna 34 radiates the multi-path interference wave in synchronism with the road-to-vehicle communication of the roadside antenna 23, thereby preventing multi-path. In this case, the multi-path interference wave radiated by the multi-path interference wave radiation antenna 34 may have the same carrier frequency as or a different carrier frequency from the road-to-vehicle communication of the roadside antenna 23. Also, the multi-path interference wave may be radiated continuously in the multi-path area.

Although the dimension of the wireless communication zone and the construction of the structures as described in this specification are for examples only and for ease of understanding the principle of the system according to the present invention. Needless to say that differences in the dimensions and constructions fall in the scope of the present invention.

The "radio wave absorbing member" as referred to in this specification may be sheet, panel or any other form of member made from materials having radio wave absorbing characteristic. Also, the "radio wave absorbing member" may be, for example, a combination of radio wave absorbing materials and radio wave non-absorbing material in mosaic as long as such combination has radio wave absorbing effect to some extent. The embodiments disclosed herein are only examples of the present invention and should not be considered to restrict the present invention.

As apparent from the above descriptions, the ETC system according to the present invention is effective to reliably distinguish ETC vehicles from non-ETC vehicles by establishing wireless communication between the roadside antenna and only vehicle traveling in the predetermined wireless communication zone. Also, the present invention can be applied to tollgates of various constructions having many structures in different positional relationship to improve the ETC system reliability by preventing multipath. Additionally, the present invention may be applied to any experiment/evaluation system for evaluating under identical environmental conditions compatibility and/or performance of road-to-vehicle wireless communication, roadside antenna, vehicle units, etc.

What is claimed is:

1. An electronic toll collection system for automatically collecting tolls by establishing wireless communication between a roadside antenna installed in a tollgate and a vehicle unit installed in a traveling vehicle, comprising:

at least ceiling portion of a road-to-vehicle wireless communication zone of the tollgate is covered with a structure having radio wave absorbing characteristic; and the roadside antenna is disposed inside, or in front or rear of the structure.

2. An electronic toll collection system of claim 1, wherein the inner surface of the structure is made from a radio wave absorbing member.

3. An electronic toll collection system of claim 1, wherein a radio wave absorbing member is mounted inside the structure by way of mounting member.

4. An electronic toll collection system of claim 1, wherein the structure is a semi-cylindrically dome covering the road-to-vehicle wireless communication zone.

5. An electronic toll collection system of claim 1, wherein the structure is arcuate and covers the ceiling portion of the road-to-vehicle wireless communication zone.

6. An electronic toll collection system of claim 1, wherein the structure is flat and covers the ceiling portion of the road-to-vehicle wireless communication zone.

7. An electronic toll collection system of claim 1, wherein the structure is a roof of the tollgate.

8. An electronic toll collection system of claim 1, wherein the structure is a raised highway.

9. An electronic toll collection system of claim 7, wherein the area of the radio wave absorbing member is substantially equal to the road-to-vehicle wireless communication zone.

10. An electronic toll collection system of claim 7, wherein the dimension of the radio wave absorbing member in the direction of width of the lane is equal to the sum of the lane and the island and the dimension in the traveling direction is substantially equal to the dimension of the road-to-vehicle wireless communication zone in the traveling direction.

11. An electronic toll collection system of claim 7, wherein panels of the radio wave absorbing member are secured to the structure by using beams.

12. An electronic toll collection system for automatically collecting tolls by establishing wireless communication between a roadside antenna installed in a tollgate and a vehicle unit installed in a vehicle, characterized in that:

the entire or a part of the inner surface of a roof covering a road-to-vehicle wireless communication zone of the tollgate, side walls, signboards, vehicle detectors, antenna supports, islands or the road near the road-to-vehicle wireless communication zone is covered with a radio wave absorbing member.

13. An electronic toll collection system of claim 12, wherein the radio wave absorbing member comprises a mixture of magnetic material and synthetic rubber or polymer.

14. An electronic toll collection system of claim 12, wherein the radio wave absorbing member comprises a $\lambda$-4 type radio wave absorbing member using a resistive film.

15. An electronic toll collection system of claim 12, wherein the radio wave absorbing member comprises a magnetic material based radio wave absorbing member having sharp projections on the surface thereof.

16. An electronic toll collection system of claim 12, wherein the radio wave absorbing member is a multi-layer construction.

17. An electronic toll collection system of claim 12, wherein the radio wave absorbing member is formed by coating.

18. An electronic toll collection system of claim 12, wherein a radio wave disturbing member is utilized as a replacement of the radio wave absorbing member.

19. An electronic toll collection system of claim 18, wherein the radio wave absorbing member comprises a wave-shaped metal plate.

* * * * *